US006647675B1

(12) United States Patent
Castellanos

(10) Patent No.: US 6,647,675 B1
(45) Date of Patent: Nov. 18, 2003

(54) HIP AND RIDGE ATTACHMENT DEVICE

(76) Inventor: Tom Francisco Castellanos, 7962 SW. 186 St., Miami, FL (US) 33157

( * ) Notice: Subject to any disclaimer, the term of this patent is extended or adjusted under 35 U.S.C. 154(b) by 63 days.

(21) Appl. No.: 10/045,456

(22) Filed: Oct. 19, 2001

(51) Int. Cl.[7] ..... E04C 3/30
(52) U.S. Cl. ..... 52/198; 52/302.3; 52/731.7
(58) Field of Search ..... 52/302.1, 302.3, 52/199, 198, 731.7, 731.8, 730.1, 731.1, 731.9; 454/364, 365

(56) References Cited

U.S. PATENT DOCUMENTS 2,508,032 A * 5/1950 Kennedy ..... 52/731.7
3,481,263 A * 12/1969 Belden ..... 454/365
4,325,290 A * 4/1982 Wolfert ..... 454/365
4,413,458 A * 11/1983 Ting ..... 52/481
4,558,637 A * 12/1985 Mason ..... 454/365
D283,839 S * 5/1986 Kutsch et al. ..... D23/153
5,766,071 A * 6/1998 Kirkwood ..... 454/185
6,286,273 B1 * 9/2001 Villela et al. ..... 52/199
6,308,472 B1 * 10/2001 Coulton et al. ..... 52/198
6,378,256 B1 * 4/2002 Gembala ..... 52/301
6,381,916 B1 * 5/2002 Maisch et al. ..... 52/736.1

* cited by examiner

*Primary Examiner*—Carl D. Friedman
*Assistant Examiner*—Basil Katcheves
(74) *Attorney, Agent, or Firm*—A. Bordas; J. Sandchelima

(57) ABSTRACT

A hip and ridge attachment device utilized in the roofing industry for the construction of roofs. Hip and ridge attachment devices are secured onto a rooftop once the installation of roofing felt is complete, but before the completion of roof tile installation. After the installation of the instant invention, tiles are secured thereon with an adhesive. The instant invention comprises sheet metal, formed into a V-form with walls extending a predetermined length from both sides of the V-form. Said walls are outwardly bent near their distal ends to lay flush against a roof surface. Optionally, embossings on the V-form increase the effective contact area for an adhesive when applied thereon. Additionally, said invention may have louvers for ventilation means.

9 Claims, 3 Drawing Sheets

HIP AND RIDGE ATTACHMENT DEVICE

BACKGROUND OF THE INVENTION

1. Field of the Invention

The present invention relates to a roofing ridge installation, and more particularly, to a hip and ridge attachment device secured on rooftops.

2. Description of the Related Art

In conventional ridge installations, tiles such as roof tiles, abut at the roof ridge. This causes a juncture or seam, which creates a likely area for leaks, which is particularly undesirable where a wooden or metal understructure is used. Exposed fasteners also create the potential for leaks. Similar problems exist for hip installations. Conventional ridge installations are not only prone to leaks but are also difficult to install, difficult to ventilate and vulnerable to wind damage. Typically, fasteners are placed on the corners of roof tiles, their weakest area.

Many designs for hip and ridge attachment devices have been designed in the past. None of them, however, include a hip and ridge attachment device comprising sheet metal, formed into a V-form, with walls extending a predetermined length from both sides of the V-form. In the present invention, the walls are outwardly bent near their distal ends to lay flush against a roof surface. Therefore, this invention may be installed onto a hip or ridge as a single piece. Optionally, embossings on the V-form increase the effective contact area when an adhesive is placed thereon. Furthermore, ventilation means may be incorporated into the instant invention when necessary.

Applicant believes that the closest reference corresponds to U.S. Pat. No. 5,713,158 issued to Gibbs for Roofing Ridge Installation. However, it differs from the present invention because Gibbs teaches a roofing ridge (or hip) installation including a roof understructure having a pair of outwardly sloping walls which form an inverted V-shaped ridge. A support panel is mounted on each of the walls with the lower end of each support panel optionally terminating in an upwardly facing channel. Tiles such as slates are mounted in each channel. A pressure applying assembly forces the base end of the panels inwardly. A cap spans across and covers the upper ends of the panels and assembly.

U.S. Pat. No. 6,015,343 issued to Castillo, et al. for Tile Roof Vent teaches a tile roof vent for covering the opening of the ridge of an undulating tile roof. The vent includes two panels spaced from each other, each of which has a hard plastic sheet with a lower portion and an upper portion. To the underside of the lower portions are affixed an air-permeable mat and optionally a layer of foam rubber which conform to the undulating configuration of the tile roof. The lower portions of the hard plastic sheets are reinforced by stiffeners integral with the hard plastic sheet and also contain vent holes for exhausting air from the attic space.

Additionally, U.S. Pat. No. 4,977,714 issued to Gregory, Jr. for Roof Ventilation Baffle teaches a roof ventilation baffle comprising a pleated or corrugated membrane forming a plurality of air passages. The baffle is installed between the underside of the roof sheathing and the upper surface of fiberglass insulation bats with the pleats parallel to the rafters or roof joists to provide ventilation, along the underside of the roof sheathing. The ventilation baffle is also applicable to outside walls and floors over unheated or uncooled spaces. The baffle may be perforated to provide airflow between the air passages formed by the pleats and to permit any moisture trapped in the insulation to evaporate into and be removed by the airflow through the channels.

Other patents describing the closest subject matter provide for a number of more or less complicated features that fail to solve the problem in an efficient and economical way. None of these patents suggest the novel features of the present invention.

SUMMARY OF THE INVENTION

A roofing attachment device comprising an elongated flat member having first and second coextensive elongated walls kept at a predetermined and parallel and spaced apart relationship with respect to each other. The first and second coextensive elongated walls including each first and second longitudinal edges, and a coextending elongated cover channel wall joining the first longitudinal edges. The coextending elongated cover channel wall has a V-shape cross-section defining a longitudinal trough area. Further included are first and second elongated flanges extending from the second longitudinal edges.

Optionally, the instant invention may comprise a plurality of embossings on the V-shape cross-section. The embossings increase the effective contact area when an adhesive is placed thereon. Another option includes a plurality of louvers pressed out of the first and second coextensive elongated walls, as ventilation means to ventilate a roof or roof understructure. To prevent foreign matter such as ice, snow, or water from entering through the louvers, the instant invention may have elongated flanged strip members mounted thereon, wherein said elongated flanged strip members may be mounted below said louvers.

The first and second elongated flanges lay flush against a roof understructure. The roof understructure has a pair of outwardly sloping sides, which form an inverted V-shaped hip or ridge.

The roofing attachment device is made of a durable, weather resistant material such as, but not limited to, metal or plastic and could be of various thickness.

It is therefore one of the main objects of the present invention to provide a hip and ridge attachment device which can be conveniently mounted in an effective manner.

It is still another object of the present invention to provide a hip and ridge attachment device having embossings to increase the effective contact area when an adhesive is placed thereon.

It is another object of the present invention to provide a ridge attachment device, which will allow for proper ventilation from an attic below a roof understructure.

It is another object of the present invention to provide a hip and ridge attachment device, which is easily and quickly installed.

It is another object of the present invention to provide a hip and ridge attachment device that will not warp or rot.

It is yet another object of this invention to provide such a device that does not require special strapping for its installation.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

In accordance with this invention, the hip and ridge attachment device includes a roof understructure which could be the framework (rafters) and/or the roof deck wherein the understructure has a pair of outwardly sloping sides to form an inverted V-shaped ridge or hip.

Figure 1:
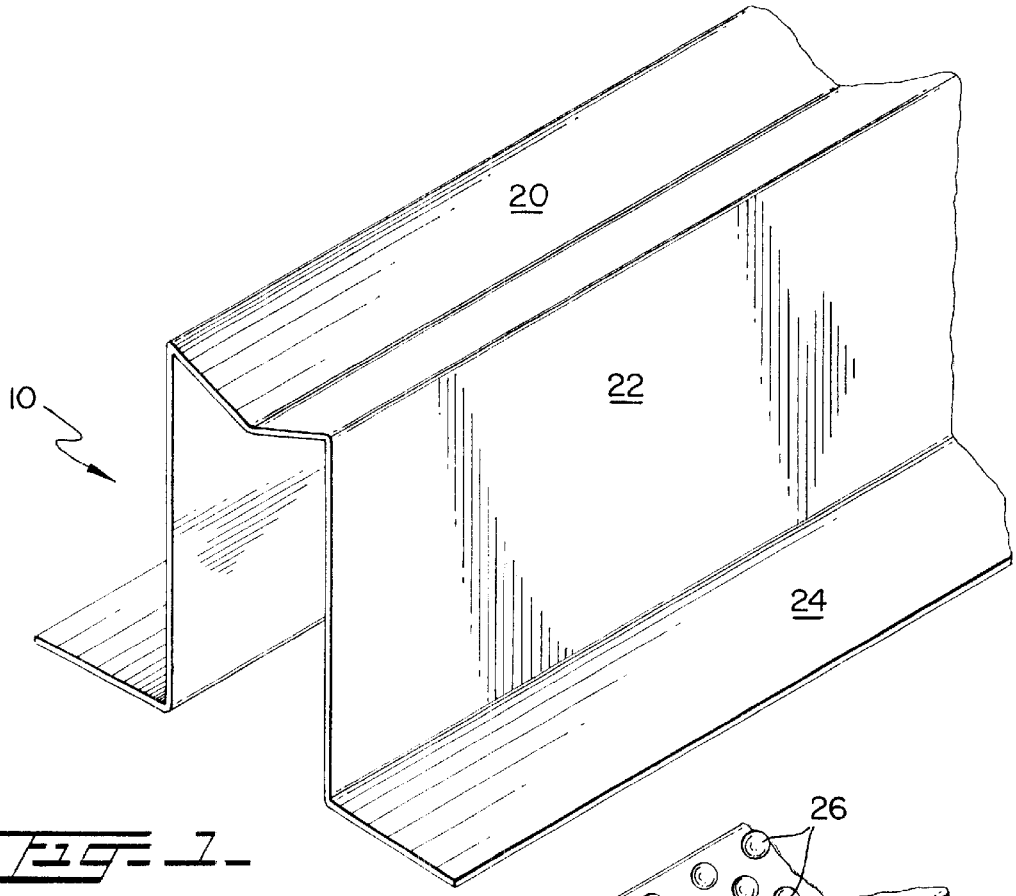
FIG. 1 represents a perspective view of the instant invention.

Referring now to the drawings, and particularly FIG. 1, the present invention is generally referred to with numeral 10. It can be observed that it basically includes V-form 20, with walls 22 extending a predetermined length from each side of V-form 20. Walls 22 are outwardly bent near their distal ends, establishing deck flanges 24, which lay flush against a roof surface. In the preferred embodiment, the instant invention is made of a galvanized metal. Additionally, the instant invention may be made of a galvanized metal of approximately 26 gauge.

Figure 2:
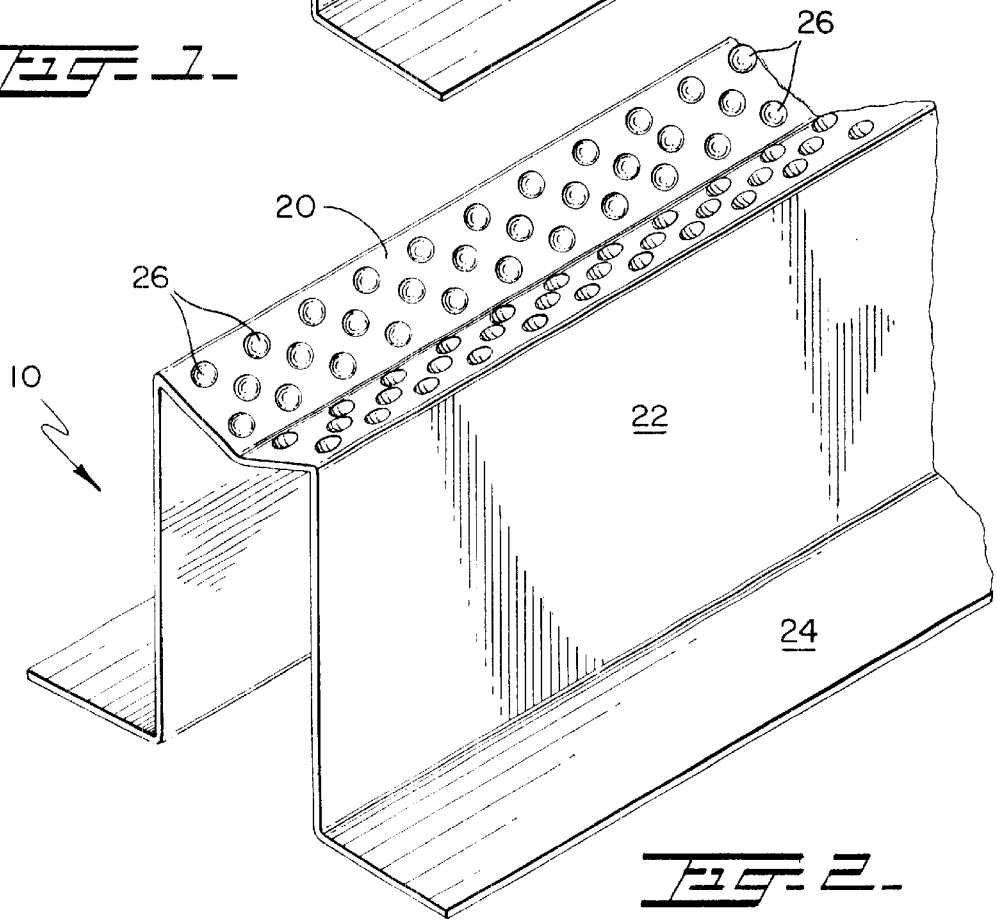
FIG. 2 represents an alternate embodiment of the instant invention.

As seen in FIG. 2, a plurality of embossings 26 may be made upon the surface of V-form 20 as an alternate embodiment. Embossings 26, on V-form 20, increase the effective contact area for adhesive 64 to secure tile 60, seen in FIG. 7.

Figure 3:
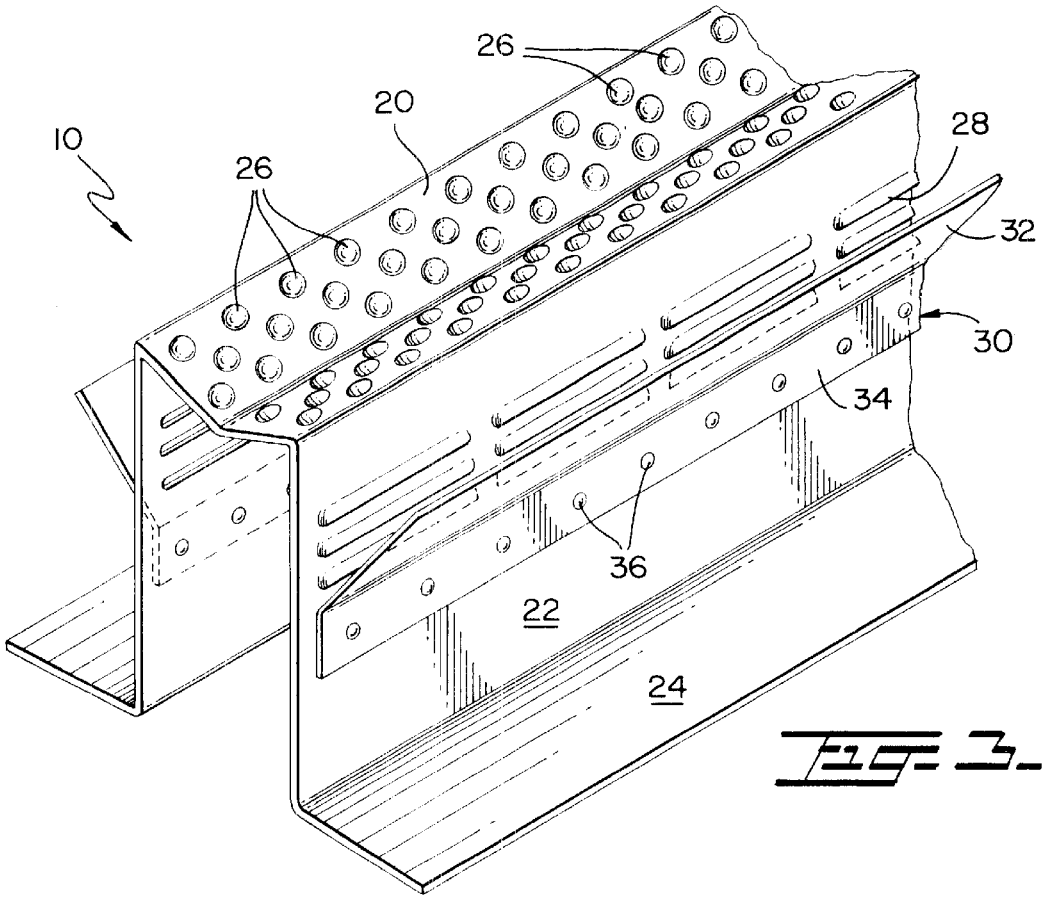
FIG. 3 represents another alternate embodiment of the instant invention.

FIG. 3 shows a further variation of the invention wherein louvers 28 extend from walls 22. In this variation, louvers 28 are pressed out of walls 22. Additionally, below louvers 28, is weather bar assembly 30. Weather bar assembly 30 comprises a single elongated member defined as angled member 32 and flush member 34. Flush member 34 is secured against walls 22 with rivets 36, or similar means for attachment. Weather bar assembly 30 prevents foreign matter such as ice, snow, water, or other, from entering through louvers 28.

Figure 3A:
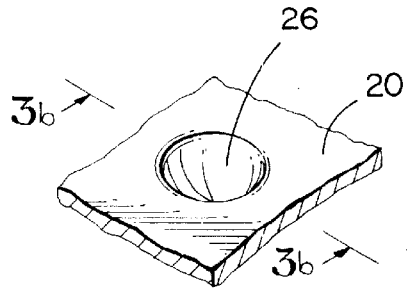
FIG. 3*a* is an embossing of the alternate embodiments seen in FIGS. 2 and 3.
Figure 3C:
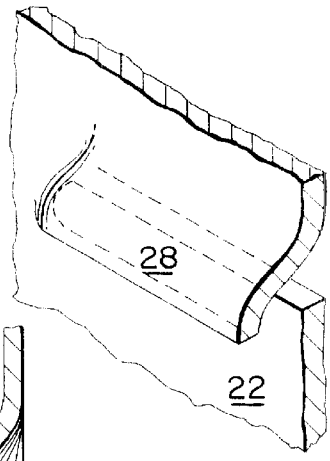
FIG. 3*c* louver section of the alternate embodiment seen in FIG. 3.
Figure 3B:
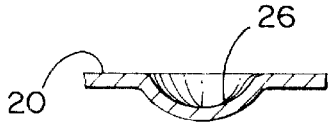
FIG. 3*b* is a cut view of the embossing taken along the line 3*b*—3*b*, as seen in FIG. 3*a*.

FIGS. 3*a* and 3*b* show embossing 26, indented into V-form 20. In this embodiment, embossing 26 is circularly concave; however, embossings 26 may be pressed into a variety of geometric shapes and may be of any depth.

Figure 3D:
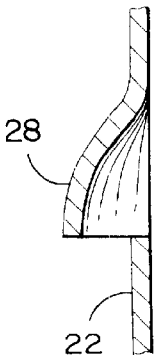
FIG. 3*d* is a cut view of the louver section taken along the line 3*d*—3*d*, as seen in FIG. 3*c*.

FIGS. 3*c* and 3*d* show louvers 28, protruding from wall 22. In this embodiment, louver 28 may be pressed out of wall 22, however, other forms of ventilation may be utilized in place of louver 28.

Figure 4:
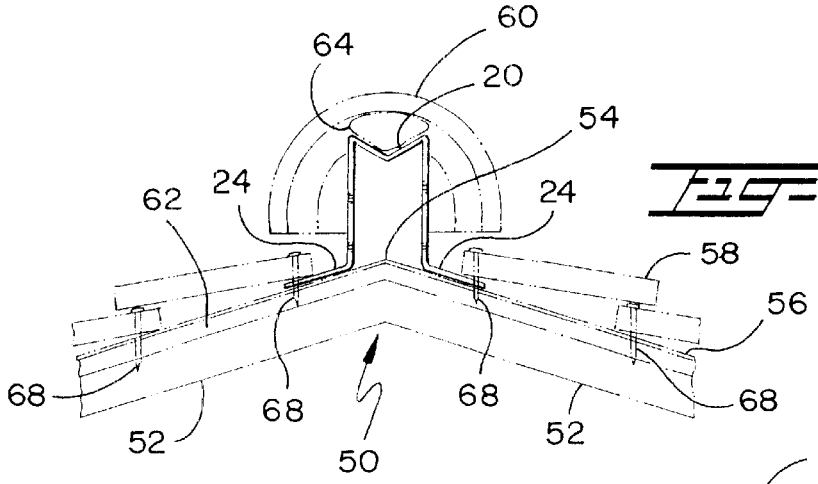
FIG. 4 is a front elevation view of the instant invention, installed on a ridge or hip.

Seen in FIG. 4 is instant invention 10, installed on a conventional ridge or hip, defined as roofing understructure 50. Roofing understructure 50 includes rafters 52, which form peak 54. Rafters 52 have roof deck 62 mounted thereon. Conventionally, such an understructure is made of wood or other suitable materials, which would tend to rot or degrade, or is made of metal which would tend to corrode when exposed to water such as rain water, as could result where the roof structure self is not sufficiently leak proof.

To protect roofing understructure 50, tiles 58 and 60 are secured thereon. Tiles 58 are secured to roofing understructure 50 with nails 68. In this embodiment, some nails 68 trespass deck flanges 24, to secure instant invention 10 upon peak 54 of roofing understructure 50. Once deck flanges 24 are secured, roofing adhesive 64 is applied onto V-form 20, and then tile 60 is placed thereon. Roofing adhesive 64 is designed to withstand weather conditions and creates a permanent bond to tile 60, once dried.

Figure 5:
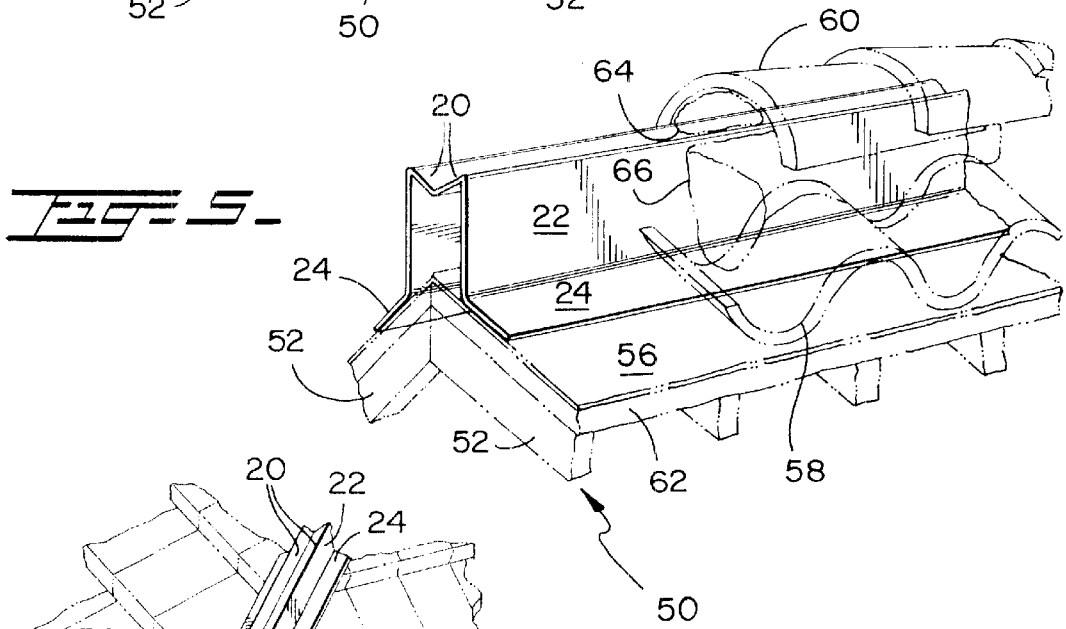
FIG. 5 is a perspective view of the instant invention with roofing accessories.

Seen in FIG. 5 is instant invention 10 cooperating with various roofing components. Roofing understructure 50 includes rafters 52 and roof deck 62, which may be a plywood or composite board having roofing felt 56 on its outer surface. Roofing understructure 50 may also be tracks or battens, which in turn may optionally be secured to roof deck 62. In this embodiment, mortar 66 is utilized to secure tile 58.

Figure 6:
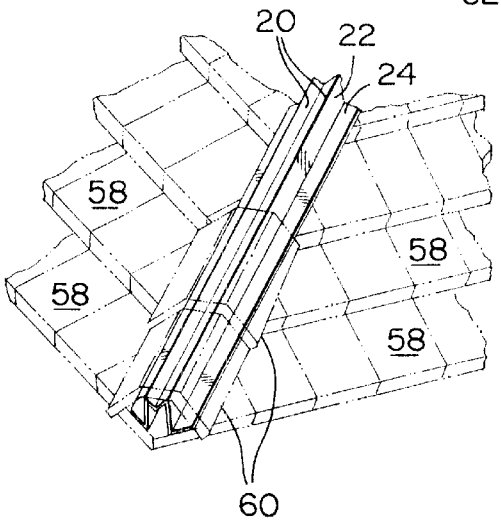
FIG. 6 is a top perspective view of the instant invention with some roof tiles installed.

As seen in FIG. 6, instant invention 10, is also mounted on inclined hips with preceding lower rows of roofing tile 58 mounted to roof deck 62. In this conventional manner, rows of the tiles overlap each other starting from the lower of the roof which has the first row of tiles and then succeeding rows are mounted thereover in an overlapping fashion as is known in the art.

Figure 7:
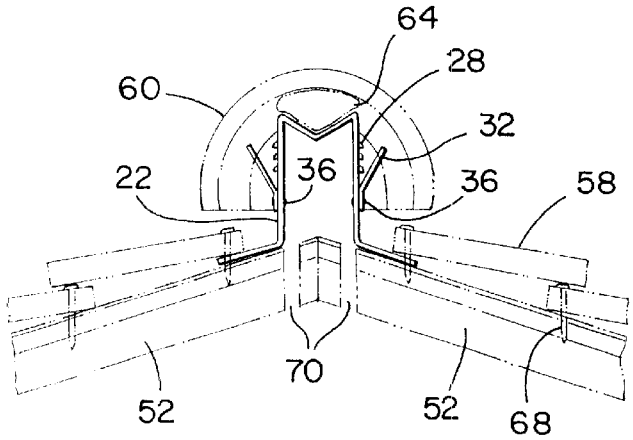
FIG. 7 is a front elevation view of the embodiment seen in FIG. 3, installed on a ridge with ventilation passages.

Seen in FIG. 7 is an illustrated embodiment installed on a ridge with ventilation passages 70 for ventilation purposes.

Instant invention 10 could be utilized on a hip section, a ridge, and where two adjacent roof sections intersect at an angle. Thus the term ridge is intended to be used not only in the conventional sense, but also to include sections, which intersect at an angle to form a peak, horizontally or inclined.

In the illustrated and preferred practice of this invention, the tiles or roofing shingle is of a rigid material. The invention however, could be used with all types of roofing tiles.

The advantages of the present invention include the installation in an effective manner wherein any roof pitch could be accommodated. Additionally, the height and width of the instant invention may vary to accommodate different tile profiles.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A roofing attachment device in combination with a roof comprising an elongated flat member having first and second coextensive elongated walls kept at a predetermined and parallel and spaced apart relationship with respect to each other, said first and second coextensive elongated walls including each first and second longitudinal edges, and a coextending elongated cover channel wall joining said first longitudinal edges of said first and second coextensive elongated walls, said coextending elongated cover channel wall having a V-shape cross-section defining a longitudinal trough area, and further including flat first and second elongated flanges outwardly extending from said second longitudinal edges of said first and second coextensive elongated walls, said flat first and second elongated flanges attached onto the roof.

2. The roofing attachment device in combination with a roof set forth in claim 1, further comprising a plurality of embossings on said V-shape cross-section, said embossings to increase the effective contact area when an adhesive is placed thereon.

3. The roofing attachment device in combination with a roof set forth in claim 2, further comprising a plurality of louvers pressed out of said first and second coextensive elongated walls as ventilation means to ventilate a roof.

4. The roofing attachment device in combination with a roof set forth in claim 3, wherein first and second coextensive elongated walls each have an elongated flanged strip member mounted thereon to prevent foreign matter from entering through said louvers.

5. A roofing attachment device comprising an elongated flat member having first and second coextensive elongated walls kept at a predetermined and parallel and spaced apart relationship with respect to each other, said first and second coextensive elongated walls including each first and second longitudinal edges, and a coextending elongated cover channel wall joining said first longitudinal edges of said first and second coextensive elongated walls, said coextending elongated cover channel wall having a V-shape cross-section defining a longitudinal trough area, and further including first and second elongated flanges extending from said second longitudinal edges of said first and second coextensive elongated walls to lay flush against a roof understructure, said roof understructure having a pair of outwardly sloping sides which form an inverted V-shaped hip or ridge, said V-shape cross-section further comprising a plurality of embossings to increase the effective contact area when an adhesive is placed thereon, and said first and second coextensive elongated walls further comprising a plurality of louvers as ventilation means to ventilate said roof understructure.

6. The roofing attachment device set forth in claim 5, wherein first and second coextensive elongated walls each have an elongated flanged strip member mounted thereon to prevent ice, snow, or water from entering through said louvers.

7. The roofing attachment device set forth in claim 6, wherein said roofing attachment device is made of galvanized metal.

8. The roofing attachment device set forth in claim 7, wherein said roofing attachment device is made of galvanized metal and is approximately 26 gauge.

9. The roofing attachment device set forth in claim 8, wherein said elongated flanged strip members are mounted below said louvers.

* * * * *